US010722899B2

(12) United States Patent
Matsumoto et al.

(10) Patent No.: US 10,722,899 B2
(45) Date of Patent: Jul. 28, 2020

(54) VERTICAL ROLLER MILL

(71) Applicant: MITSUBISHI HITACHI POWER SYSTEMS, LTD., Yokohama (JP)

(72) Inventors: Shinji Matsumoto, Tokyo (JP); Takuichiro Daimaru, Tokyo (JP); Kenichi Arima, Tokyo (JP); Taku Miyazaki, Tokyo (JP); Kazushi Fukui, Yokohama (JP); Hidechika Uchida, Yokohama (JP)

(73) Assignee: MITSUBISHI HITACHI POWER SYSTEMS, LTD., Yokohama (JP)

( * ) Notice: Subject to any disclaimer, the term of this patent is extended or adjusted under 35 U.S.C. 154(b) by 211 days.

(21) Appl. No.: 15/524,052

(22) PCT Filed: Aug. 31, 2015

(86) PCT No.: PCT/JP2015/074797
§ 371 (c)(1),
(2) Date: May 3, 2017

(87) PCT Pub. No.: WO2016/084447
PCT Pub. Date: Jun. 2, 2016

(65) Prior Publication Data

US 2017/0320064 A1 Nov. 9, 2017

(30) Foreign Application Priority Data

Nov. 28, 2014 (JP) ..... 2014-241590

(51) Int. Cl.
*B02C 15/04* (2006.01)
*B02C 15/00* (2006.01)
(Continued)

(52) U.S. Cl.
CPC ..... *B02C 15/04* (2013.01); *B02C 15/007* (2013.01); *B02C 23/30* (2013.01); *B07B 7/083* (2013.01); *B02C 2015/002* (2013.01)

(58) Field of Classification Search
CPC .. B02C 15/007; B02C 15/04; B02C 2015/002
(Continued)

(56) References Cited

U.S. PATENT DOCUMENTS 4,684,069 A * 8/1987 Hashimoto ..... B02C 15/04 241/119
5,244,157 A * 9/1993 Brundiek ..... B02C 15/04 241/119
(Continued)

FOREIGN PATENT DOCUMENTS

CN 88 1 01496 10/1988
EP 0 283 682 9/1988
(Continued)

OTHER PUBLICATIONS

Office Action dated Nov. 21, 2017 in Japanese Patent Application No. 2014-241590, with English translation.
(Continued)

*Primary Examiner* — Faye Francis
(74) *Attorney, Agent, or Firm* — Wenderoth, Lind & Ponack, L.L.P.

(57) ABSTRACT

Provided is a vertical roller mill equipped with a rotary classifier for causing a plurality of classification blades provided above a rotary table and positioned around an axis to rotate about the axis, wherein: of a solid fuel pulverized by a roller, the rotary classifier guides solid fuel fine powder from an outer-circumferential-side space to an inner-circumferential-side space surrounded by the plurality of classification blades, and suppresses, by collision with the plurality of classification blades, an intrusion of solid fuel coarse
(Continued)

powder into the inner-circumferential-side space; and each of the plurality of classification blades is shaped in a manner such that there is no interference between a scattering direction in which the coarse powder that collided with the classification blades scatters and an intake direction in which the fine powder is guided to the inner-circumferential-side space, and the scattering direction is oriented upward relative to a horizontal direction.

5 Claims, 5 Drawing Sheets

(51) Int. Cl.
*B02C 23/30* (2006.01)
*B07B 7/083* (2006.01)

(58) Field of Classification Search
USPC ..... 241/209
See application file for complete search history.

(56) References Cited

U.S. PATENT DOCUMENTS 5,657,877 A * 8/1997 Yoshida ..... B07B 7/083 209/303
7,118,055 B2 * 10/2006 Chang ..... B02C 15/003 241/79.1
7,350,727 B2 * 4/2008 Kronz ..... B02C 15/00 241/24.14
7,913,851 B2 * 3/2011 Chang ..... B02C 15/003 209/139.1
8,820,535 B2 * 9/2014 Wark ..... B07B 7/083 209/138
2010/0276525 A1 * 11/2010 Matsumoto ..... B02C 15/04 241/49
2012/0012687 A1 * 1/2012 Vierstra ..... B02C 23/10 241/79
2012/0175446 A1 * 7/2012 Chang ..... B02C 15/003 241/79
2013/0200187 A1 * 8/2013 Wark ..... B07B 7/083 241/68

FOREIGN PATENT DOCUMENTS

| | | |
|---|---|---|
| EP | 0 496 124 | 12/1991 |
| JP | 60-114356 | 6/1985 |
| JP | 64-22386 | 1/1989 |
| JP | 2-26651 | 1/1990 |
| JP | 2-10698 | 3/1990 |
| JP | 2-70737 | 5/1990 |
| JP | 2-137940 | 11/1990 |
| JP | 4-235755 | 8/1992 |
| JP | 5-68904 | 3/1993 |
| JP | 6-55088 | 3/1994 |
| JP | 2617623 | 6/1997 |
| JP | 2002-233825 | 8/2002 |
| JP | 2005-324104 | 11/2005 |
| JP | 2011-104492 | 6/2011 |

OTHER PUBLICATIONS

Office Action dated Jul. 26, 2018 in corresponding Chinese Application No. 201580059990.9, with English Translation.
International Search Report dated Nov. 24, 2015 in corresponding International Application No. PCT/JP2015/074797.
Written Opinion of the International Searching Authority dated Nov. 24, 2015 in corresponding International Application No. PCT/JP2015/074797.

* cited by examiner

VERTICAL ROLLER MILL

TECHNICAL FIELD

The present invention relates to a vertical roller mill equipped with a rotary classifier.

BACKGROUND ART

A roller mill equipped with a classifying unit that pulverizes a solid fuel such as coal and classifies a fine powder smaller than a predetermined particle size is known (refer to Patent Document 1, for example). The roller mill disclosed in Patent Document 1 includes a classification auxiliary cone in which a rotary classifying unit is disposed. The classification auxiliary cone includes a plurality of drift plates in an upper end portion thereof. These drift plates change the flow of the solid fuel to a sideways swirling flow toward the rotary classifying unit.

The roller mill disclosed in Patent Document 1 guides the solid fuel, rising due to hot air, into the interior of the classification auxiliary cone in a sideways swirling flow produced by the drift plates, and causes a coarse powder included in the solid fuel to fall downward from an inner wall surface of the classification auxiliary cone. The coarse powder that falls from the classification auxiliary cone is once again pulverized by a pulverizing roller on a table. Fine powder smaller than a predetermined particle size and classified by the rotary classifying unit inside the classification auxiliary cone is guided to an area outside the roller mill.

CITATION LIST

Patent Document

Patent Document 1: Japanese Patent No. 2617623B

SUMMARY OF INVENTION

Technical Problem

In the roller mill disclosed in Patent Document 1, the rotary classifier includes a rotating blade inclined downward. Thus, when the rotating blade collides with the coarse powder, the coarse powder scatters downward. When the rotary classifying unit includes a classification auxiliary cone as in the roller mill disclosed in Patent Document 1, the coarse powder scattered downward is collected and fed to a table by the classification auxiliary cone.

Nevertheless, when the roller mill includes a rotary classifying unit that does not use a classification auxiliary cone, there is interference between the scattering coarse powder and the fine powder that is to flow into an inner-circumferential-side space of the rotary classifying unit when the coarse powder scatters downward, decreasing an intake efficiency of the fine powder to the inner-circumferential-side space.

Further, as a result of this interference, a portion of the scattering coarse powder mixes with the fine powder that is to flow into the inner-circumferential-side space, causing the portion of coarse powder to flow from an outer-circumferential-side space to the inner-circumferential-side space.

In light of the foregoing, it is an object of the present invention to provide a vertical roller mill that enhances an intake efficiency of a fine powder from an outer-circumferential-side space to an inner-circumferential-side space of a rotary classifier and suppresses the flow of a coarse powder from the outer-circumferential-side space into the inner-circumferential-side space.

Solution to Problem

The present invention adopts the following means in order to solve the abovementioned technical problem.

A vertical roller mill according to an aspect of the present invention includes a rotary table that rotates about an axis by a driving force from a drive unit, a fuel supply unit for supplying a solid fuel to the rotary table, a roller for pulverizing the solid fuel supplied to the rotary table, a rotary classifier for causing a plurality of blades provided above the rotary table and disposed around the axis to rotate about the axis, and a ventilation unit for blowing oxidizing gas for supplying the solid fuel pulverized by the roller to the rotary classifier. Of the solid fuel pulverized by the roller, the rotary classifier guides fine powder smaller than a predetermined particle size from an outer-circumferential-side space to an inner-circumferential-side space surrounded by the plurality of blades, and suppresses, by collision with the plurality of blades, an intrusion of coarse powder larger than the predetermined particle size into the inner-circumferential-side space. Each of the plurality of blades is shaped in a manner such that there is no interference between a scattering direction in which the coarse powder that collided with the blades scatters and an intake direction in which the fine powder is guided to the inner-circumferential-side space, and the scattering direction is oriented upward relative to the horizontal direction.

According to the vertical roller mill of this aspect of the present invention, the solid fuel supplied to the rotary table by the fuel supply unit is guided to the outer-circumferential-side space of the rotary classifier along with the oxidizing gas blown by the ventilation unit upon pulverization by the roller. Of the pulverized solid fuel, fine powder smaller than the predetermined particle size is guided from the outer-circumferential-side space to the inner-circumferential-side space surrounded by the plurality of blades. Meanwhile, the intrusion of coarse powder larger than the predetermined particle size into the inner-circumferential-side space caused by collision with the plurality of blades is suppressed.

According to the vertical roller mill of this aspect of the present invention, there is no interference between the scattering direction in which the coarse powder that collided with the blades of the rotary classifier scatters, and the intake direction in which the fine powder is guided to the inner-circumferential-side space. As a result, disruption of the flow of fine powder into the inner-circumferential-side space by the coarse powder is suppressed, making it possible to enhance the intake efficiency of the fine powder from the outer-circumferential-side space to the inner-circumferential-side space.

Further, each of the blades collides with the coarse powder, the coarse powder scatters in a direction oriented upward relative to the horizontal direction. As a result, an air stream flow oriented upward from below is formed in a region near the blade of the outer-circumferential-side space, making it possible to suppress a defect in which the coarse powder flows from the outer-circumferential-side space into the inner-circumferential-side space due to disturbance of the air stream flow.

In the vertical roller mill according to another aspect of the present invention, a surface through which an outer circumferential side end portion of each of the plurality of blades centered around the axis passes may be a side surface of a circular truncated cone that protrudes downward from above along the axis. In such a configuration, an angle formed by the side surface of the circular truncated cone and a plane orthogonal to the axis is from 65 degrees to 75 degrees, both inclusive. Preferably, in particular, this angle is set to 70 degrees.

The inventors changed the angle formed by the side surface of the circular truncated cone serving as the surface through which the outer circumferential side end portion of each of the plurality of blades passes, and the plane orthogonal to the axis, compared the classification performances of the rotary classifier, and discovered that a high classification performance can be achieved by setting this angle to a value from 65 degrees to 75 degrees, both inclusive. In particular, the inventors discovered that a high classification performance can be achieved by setting this angle to 70 degrees.

Here, "classification performance" refers to an integrated weight ratio of a fine powder of a carbonaceous solid fuel that was passed through the rotary classifier and classified, the fine powder having a size less than or equal to a first particle size (75 μm, for example), and an integrated weight ratio of a coarse powder of a carbonaceous solid fuel that was passed through the rotary classifier and classified, the coarse powder having a size greater than or equal to a second particle size (150 μm, for example) greater than the first particle size. A higher numeric value of the former and a lower numeric value of the latter result in a higher ratio of fine powder, a lower ratio of coarse powder, and thus a higher classification performance.

According to this configuration, the inclination angle of the side surface of the circular truncated cone serving as the surface through which the outer circumferential side end portion of each of the plurality of blades passes is set to a value from 65 degrees to 75 degrees, both inclusive (preferably 70 degrees), with respect to the plane orthogonal to the axis, making it possible to enhance the intake efficiency of the fine powder from the outer-circumferential-side space to the inner-circumferential-side space of the rotary classifier and suppress the flow of the coarse powder from the outer-circumferential-side space into the inner-circumferential-side space.

In the vertical roller mill according to another aspect of the present invention, each of the plurality of blades may have a plate shape with a first end portion in a longitudinal direction disposed on an upper side along the axis and a second end portion disposed on a lower side along the axis. In such a configuration, the longitudinal direction is inclined from the axial direction so that the first end portion is in a position receded further on an upstream side of the rotary classifier in the rotational direction than the second end portion.

According to this configuration, the longitudinal direction is inclined from the axial direction so that the first end portion in the longitudinal direction of each of the plate shaped blades is in a position receded further on the upstream side of the rotary classifier in the rotational direction than the second end portion. As a result, a normal direction of each of the plate shaped blades is a direction inclined upward relative to a horizontal direction. Accordingly, the coarse powder that collides with the blades scatters in a direction oriented upward relative to the horizontal direction.

Thus, due to the action of each of the plate shaped blades having the longitudinal direction inclined from the axial direction, an air stream flow oriented upward from below is reliably formed in a region near the blade of the outer-circumferential-side space, making it possible to suppress a defect in which the coarse powder flows from the outer-circumferential-side space into the inner-circumferential-side space due to disturbance of the air stream flow.

In the vertical roller mill of the configuration described above, the longitudinal direction may be inclined at an angle of from 13 degrees to 23 degrees, both inclusive, from the axial direction when the blade is orthogonal to the axis and viewed from a radial direction that passes through the blade and the axis.

The inventors changed the inclination angle of each of the plate shaped blades having a longitudinal direction inclined from the axial direction (the angle formed by the longitudinal direction of the blade and the axial direction when the blade is viewed from the radial direction), compared the classification performances of the rotary classifier, and discovered that a high classification performance can be achieved by setting this angle to a value from 13 degrees to 23 degrees, both inclusive. In particular, the inventors discovered that a high classification performance can be achieved by setting this angle to 18 degrees.

According to this configuration, the inclination angle of each of the plate shaped blades having a longitudinal direction inclined from the axial direction (the angle formed by the longitudinal direction of the blade and the axial direction when the blade is viewed from the radial direction) is set to a value from 13 degrees to 23 degrees, both inclusive (preferably 18 degrees), making it possible to enhance the intake efficiency of the fine powder from the outer-circumferential-side space to the inner-circumferential-side space of the rotary classifier and suppress the flow of the coarse powder from the outer-circumferential-side space into the inner-circumferential-side space.

Advantageous Effects of Invention

According to the present invention, it is possible to provide a vertical roller mill that enhances an intake efficiency of a fine powder from an outer-circumferential-side space to an inner-circumferential-side space of a rotary classifier and, at the same time, suppresses the flow of a coarse powder from the outer-circumferential-side space into the inner-circumferential-side space.

DESCRIPTION OF EMBODIMENTS

The following describes a vertical roller mill of an embodiment of the present invention, with reference to the drawings.

A vertical roller mill 100 is a device that pulverizes and dries a solid fuel such as coal, and classifies the pulverized coal into fine powder smaller than a predetermined particle size.

Figure 1:
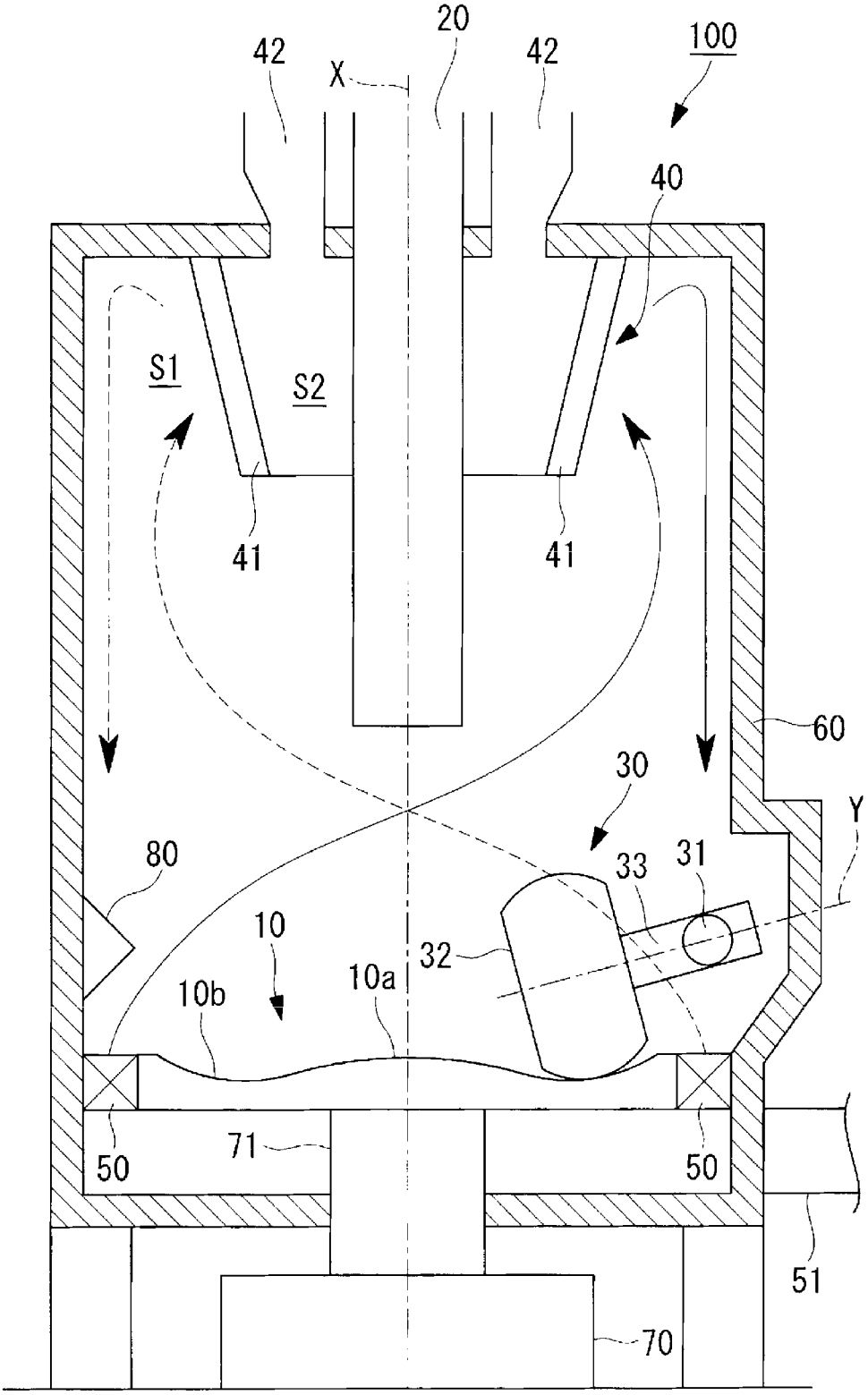
FIG. 1 is a vertical cross-sectional view illustrating a vertical roller mill of an embodiment.

As illustrated in FIG. 1, the vertical roller mill 100 of the present embodiment includes a rotary table 10, a fuel supply unit 20, a roller 30, a rotary classifier 40, a nozzle 50 (ventilation unit), a housing 60, a drive unit 70, and a swirling vane 80.

The rotary table 10 is a disc-like member that rotates about an axis X that extends in a vertical direction and serves as a central axis of the vertical roller mill 100. The rotary table 10 includes a central portion 10*a* and an outer circumferential portion 10*b*. The outer circumferential portion 10*b* has a shape that is downwardly concave along the axis X. The rotary table 10 rotates about the axis X by a driving force transmitted from the drive unit 70 via a drive shaft 71.

The fuel supply unit 20 is a cylindrical member that supplies a solid fuel from above the rotary table 10 to the central portion 10*a* along the axis X. The fuel supply unit 20 supplies the solid fuel supplied from a coal feeder (not illustrated) to the central portion 10*a* of the rotary table 10.

The roller 30 includes a roller main body 32 that presses the outer circumferential portion 10*b* of the rotary table 10, a rocking shaft 31 that serves as a central axis that rocks the roller main body 32, and a support shaft 33 that supports the roller main body 32. The roller 30 causes the roller main body 32 to rotate about the rocking shaft 31 by pressing the support shaft 33 by a pressing mechanism (not illustrated). The roller main body 32 presses the outer circumferential portion 10*b* of the rotary table 10 as the roller main body 32 rotates about the rocking shaft 31.

The roller main body 32 rotates about an axis Y while pressing the outer circumferential portion 10*b* of the rotary table 10. The roller main body 32 pulverizes the solid fuel that moves from the central portion 10*a* to the outer circumferential portion 10*b* in association with the rotation of the rotary table 10, by a pressing force imparted to the rotary table 10.

While only one roller 30 is illustrated in FIG. 1, a plurality of rollers 30 are disposed at certain intervals in a circumferential direction around the axis X so as to press the outer circumferential portion 10*b* of the rotary table 10. For example, three rollers 30 are disposed on the outer circumferential portion 10*b* at angular intervals of 120° around the axis X. In this case, the sections (pressed sections) where the three rollers 30 come into contact with the outer circumferential portion 10*b* of the rotary table 10 are equidistant from the central portion 10*a* of the rotary table 10.

The rotary classifier 40 is a device that classifies the solid fuel pulverized by the rollers 30 into fine powder smaller than the predetermined particle size by causing a plurality of classification blades 41 (blades) disposed at certain intervals to rotate about the axis X. As illustrated in FIG. 1, the rotary classifier 40 is provided so that the fuel supply unit 20 surrounds the axis X above the rotary table 10. The rotary classifier 40 is imparted with motive power for rotation about the axis X by a drive motor (not illustrated). The details of the rotary classifier 40 will be described later.

The rotary classifier 40 classifies the solid fuel into fine powder smaller than the predetermined particle size and coarse powder larger than the predetermined particle size by a balance between a centrifugal force produced by the classification blades 41 that rotate about the axis X (a force in a direction away from the axis X) and a centripetal force caused by an air stream of primary air that flows in through the nozzle 50 described later (a force in a direction toward the axis X). That is, of the solid fuel pulverized by the rollers 30, the rotary classifier 40 guides the fine powder smaller than the predetermined particle size from an outer-circumferential-side space S1 to an inner-circumferential-side space S2 surrounded by the plurality of classification blades 41. Further, the rotary classifier 40 suppresses intrusion of the coarse powder larger than the predetermined particle size into the inner-circumferential-side space S2 caused by collision with the plurality of classification blades 41.

The "predetermined particle size" here is, for example, a particle size of 75 μm or less. The rotary classifier 40 classifies the air stream mixed with a solid fuel having various particle sizes into fine powder and coarse powder. The fine powder and the coarse powder each consist of fine particles, and thus the rotary classifier 40 cannot completely separate the fine powder and the coarse powder. The rotary classifier 40 classifies the air stream so that an integrated weight ratio of the solid fuel that is included in the solid fuel supplied to a supply flow channel 42 and has a predetermined particle size or less is a certain ratio or greater. The target classification performance is, for example, set so that the integrated weight ratio of the solid fuel that is included in the solid fuel supplied to the supply flow channel 42 and has a particle size of 75 μm or less is 80% or greater.

The nozzle 50 is a device that blows primary air (primary oxidizing gas) for supplying the solid fuel pulverized by the rollers 30 to the rotary classifier 40. A plurality of the nozzles 50 are provided on the outer peripheral side of the rotary table 10 around the axis X. The nozzles 50 discharge primary air that flows in through a primary air flow channel 51 to a space above the rotary table inside the housing 60.

The swirling vane 80 is installed above the nozzles 50, and imparts a swirling force that swirls the primary air discharged from the nozzles 50 around the axis X. As indicated by the arrows of the solid line and the dashed line in FIG. 1, the primary air imparted with the swirling force by the swirling vane 80 guides the solid fuel pulverized on the rotary table 10 to the rotary classifier 40 above the housing 60. Note that, among the pulverized matter of the solid fuel mixed into the primary air, pulverized matter having a large particle size falls without reaching the inner-circumferential-side space S2 of the rotary classifier 40 and is once again returned to the rotary table 10, as indicated by the arrows of the solid line and the dashed line in FIG. 1.

The housing 60 houses each unit of the vertical roller mill 100. The tubular fuel supply unit 20 is inserted above the housing 60. Further, an upper side of the housing 60 communicates with the supply flow channel 42 that supplies fine powder smaller than the predetermined particle size to the outside by the rotary classifier 40. Further, a lower side of the housing 60 communicates with the primary air flow channel 51 that supplies the primary air.

The drive unit 70 is a driving source that causes the drive shaft 71 to rotate about the axis X. A tip end of the drive shaft 71 is connected to the rotary table 10. The rotary table 10 rotates about the axis X in association with the rotation of the drive shaft 71 about the axis X.

Next, the rotary classifier 40 of the present embodiment will be described with reference to FIGS. 2 to 4.

Figure 2:
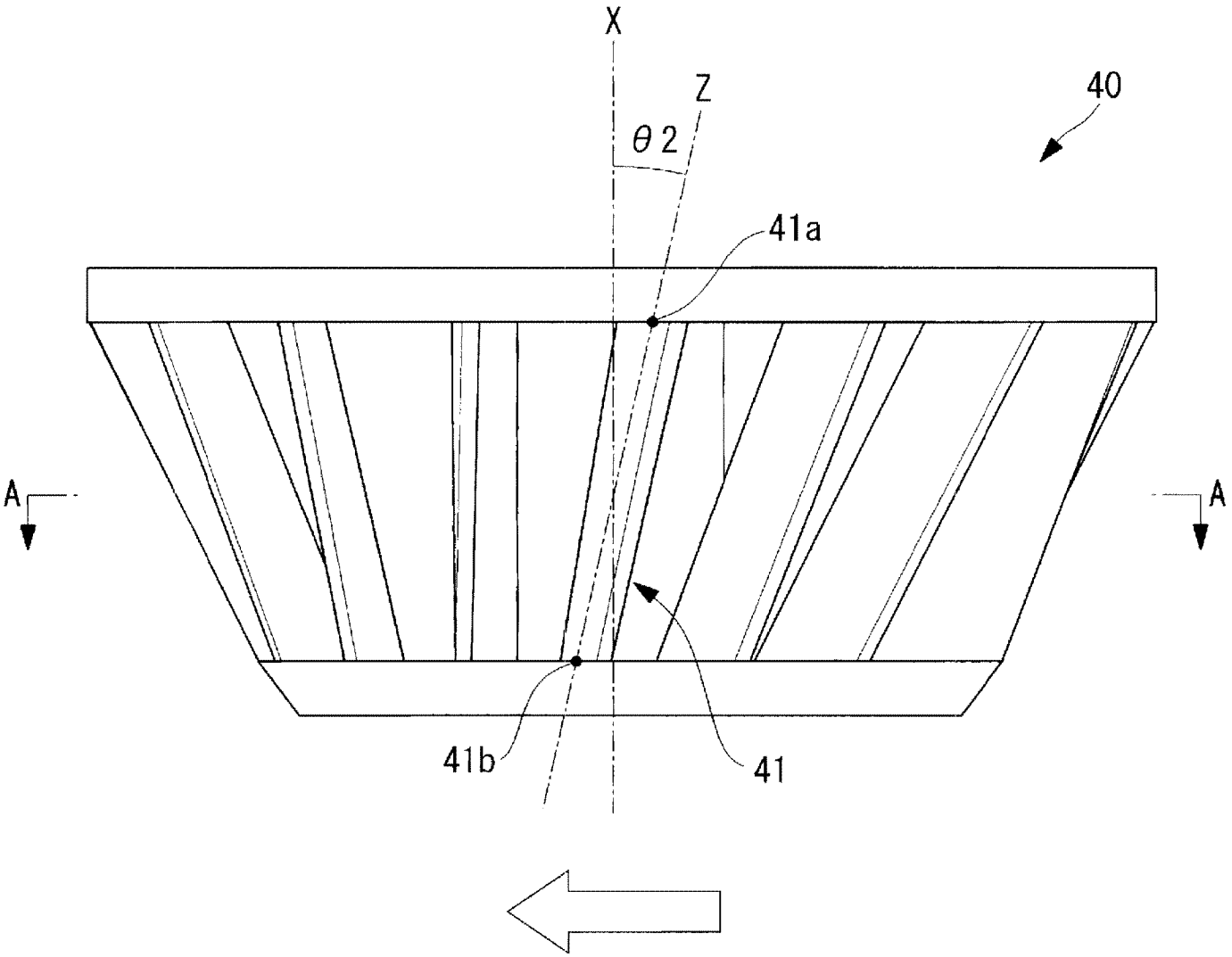
FIG. 2 is a front view of a rotary classifier illustrated in FIG. 1.
Figure 3:
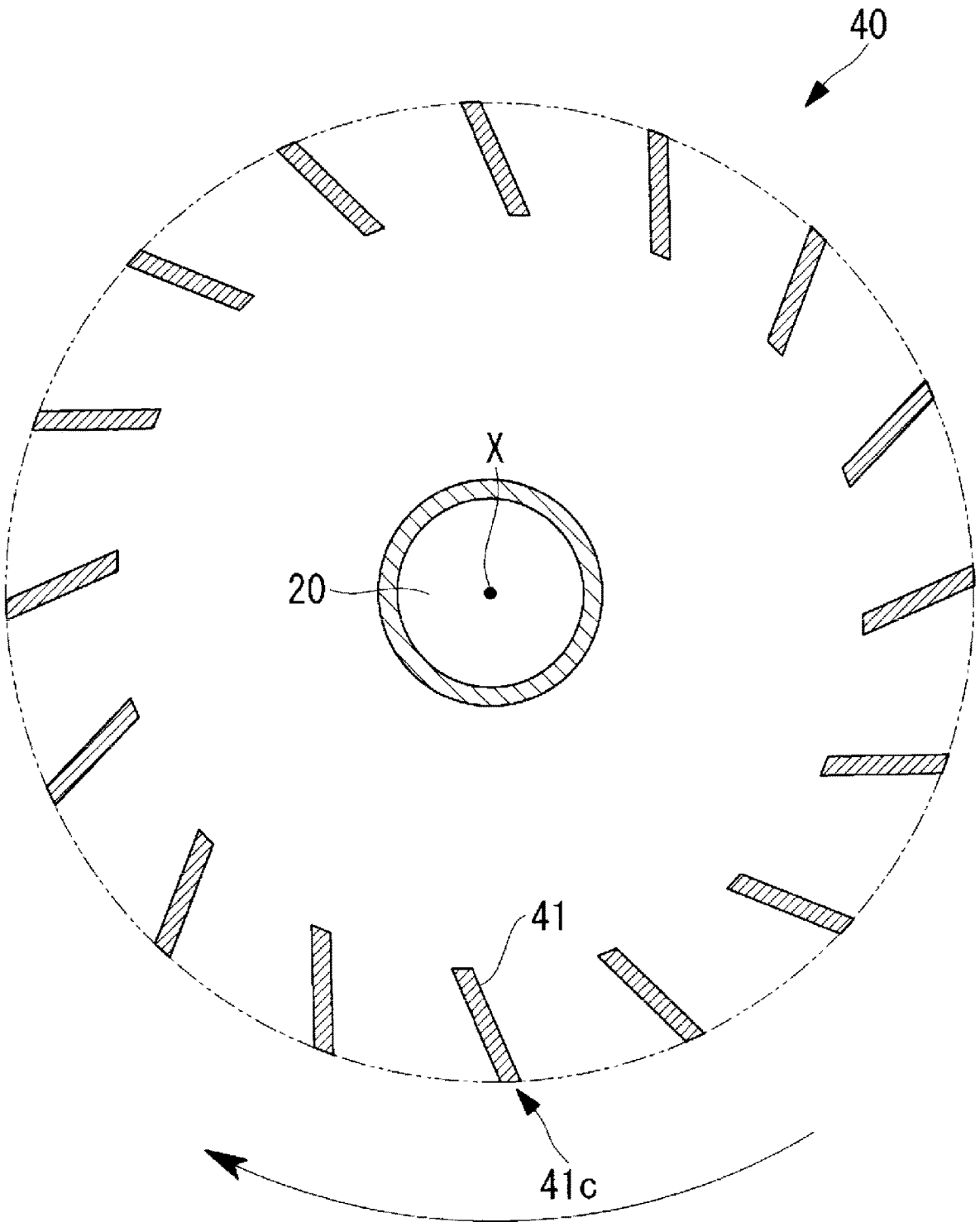
FIG. 3 is a cross-sectional view of the rotary classifier illustrated in FIG. 2, taken in the direction of arrow A-A.

As illustrated in FIG. 2, the rotary classifier 40 has a shape that protrudes downward from above along the axis X, and has a cross-sectional area of a cross section orthogonal to the axis X that gradually decreases downward from above. Further, as illustrated in FIG. 3, the position through which an outer circumferential side end portion 41*c* of each of the plurality of classification blades 41 centered around the axis X passes (the position indicated by the dashed line in FIG. 3) is a position on a circle centered around the axis X.

As a result, a surface through which the outer circumferential side end portion 41*c* of each of the plurality of classification blades 41 centered around the axis X passes is a side surface of a circular truncated cone that protrudes downward from above along the axis X.

Figure 4:
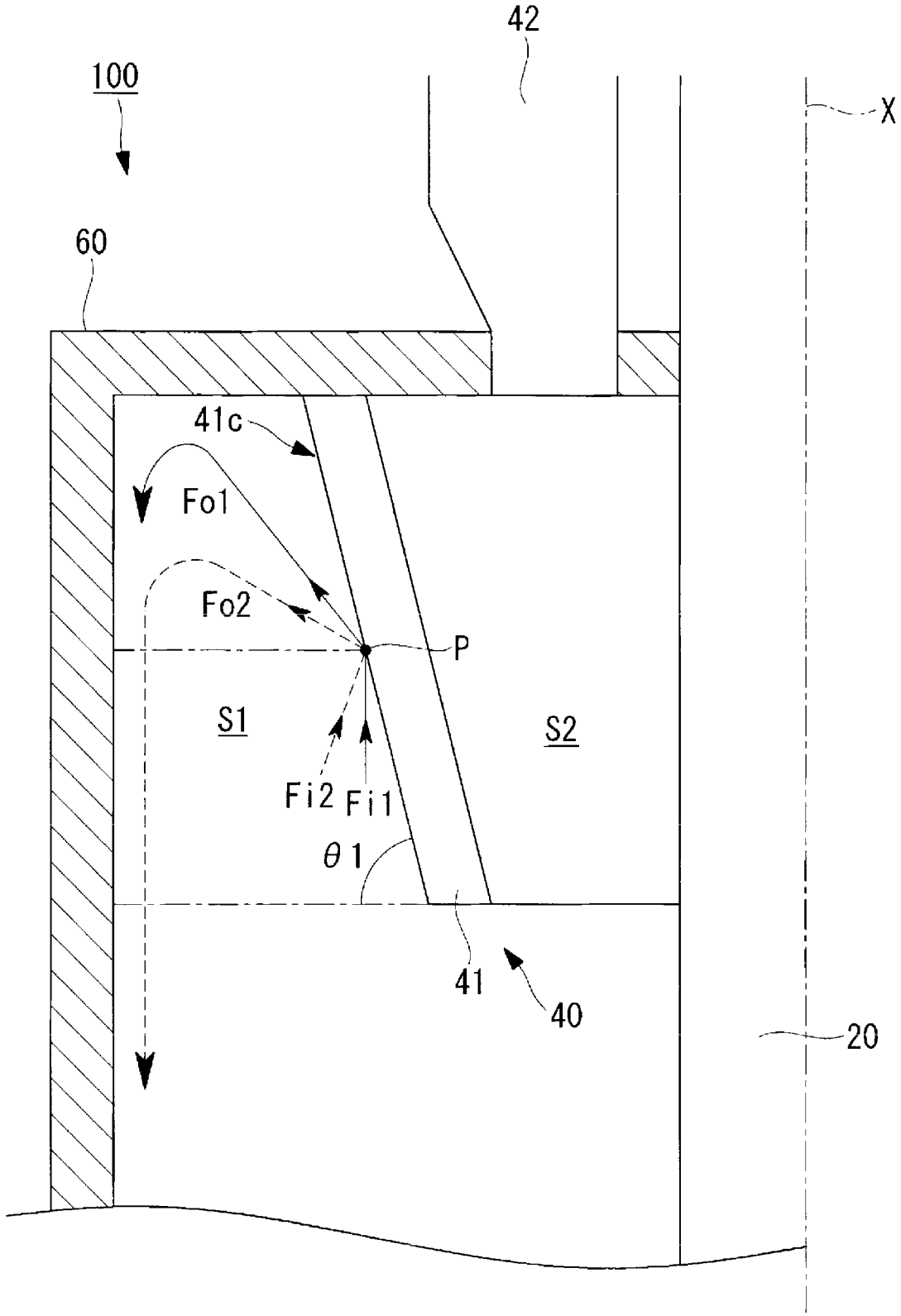
FIG. 4 is an enlarged vertical cross-sectional view of a main section of the rotary classifier illustrated in FIG. 1.

As illustrated in FIG. 4, an angle formed by the side surface of the circular truncated cone through which the outer circumferential side end portion 41*c* of each of the plurality of classification blades 41 passes, and a plane orthogonal to the axis X is θ1.

As illustrated in FIG. 2, each of the plurality of classification blades 41 is a planar member that extends in the longitudinal direction along an axis Z. Each of the plurality of classification blades 41 includes a first end portion 41*a* in the longitudinal direction on the upper side along the axis X, and a second end portion 41*b* disposed on the lower side along the axis X. As illustrated in FIG. 2, the longitudinal direction along the axis Z is inclined from the axis X direction by θ2 so that the first end portion 41*a* is in a position receded further on an upstream side of the rotary classifier 40 in the rotational direction (direction from the right toward the left indicated by the arrow in FIG. 2) than the second end portion 41*b*.

As described above, the rotary classifier 40 classifies the solid fuel into fine powder smaller than the predetermined particle size and coarse powder larger than the predetermined particle size by a balance between a centrifugal force produced by the classification blades 41 (a force in a direction away from the axis X) and a centripetal force caused by an air stream of the primary air that flows in through the nozzle 50 (a force in a direction toward the axis X). Thus, preferably there is no interference between the intake direction of the fine powder that is to flow from the outer-circumferential-side space S1 into the inner-circumferential-side space S2, and the scattering direction of the coarse powder that collided with the classification blades 41.

When there is interference between the intake direction of the fine powder and the scattering direction of the coarse powder, the intake of the fine powder is disrupted by the scattering of the coarse powder, and the scattering of the coarse powder is disrupted by the intake of the fine powder. As a result, the integrated weight ratio of the fine powder included in the solid fuel discharged from the rotary classifier 40 to the supply flow channel 42 decreases, the integrated weight ratio of the coarse powder included in the solid fuel increases, and the classification performance of the rotary classifier 40 deteriorates.

FIG. 4 illustrates an example in which the coarse powder that flowed in from below along an intake direction Fi1 parallel with the axis X collides with the classification blade 41 at a position P and scatters in a scattering direction Fo1, and the coarse powder that flowed in from below along an intake direction Fi2 inclined from the axis X collides with the classification blade 41 at the position P and scatters in the scattering direction Fo2.

When the shape of the classification blade 41 is established so that there is no interference between the intake direction of the fine powder and the scattering direction of the coarse powder, a flow is formed in which the coarse powder that scatters upon collision with the classification blade 41 scatters upward relative to the horizontal direction, arrives on the inner peripheral surface of the housing 60, and falls downward along the inner peripheral surface of the housing 60, as illustrated in FIG. 4.

To form a flow in which the coarse powder falls downward along the inner peripheral surface of the housing 60 as illustrated in FIG. 4, the coarse powder that collides with the classification blade 41 is preferably scattered toward the upper side of the housing 60 and made to reliably reach the vicinity of the inner peripheral surface.

As a result, according to this embodiment, the longitudinal direction is inclined from the axis X direction by θ2 so that the first end portion 41*a* of the classification blade 41 is in a position receded further on the upstream side of the rotary classifier 40 in the rotational direction than the second end portion 41*b*. With such an inclination, a force that causes scattering in a direction upward from the horizontal direction by θ2 is imparted to the coarse powder that collided with the classification blade 41.

As described above, the shape of the classification blade 41 is preferably a shape that does not cause interference between the scattering directions Fo1, Fo2 in which the coarse powder scatters and the intake directions Fi1, Fi2 in which the fine powder is guided to the inner-circumferential-side space S2, and forms the scattering directions Fo1, Fo2 in a direction oriented upward relative to the horizontal direction.

Figure 5:
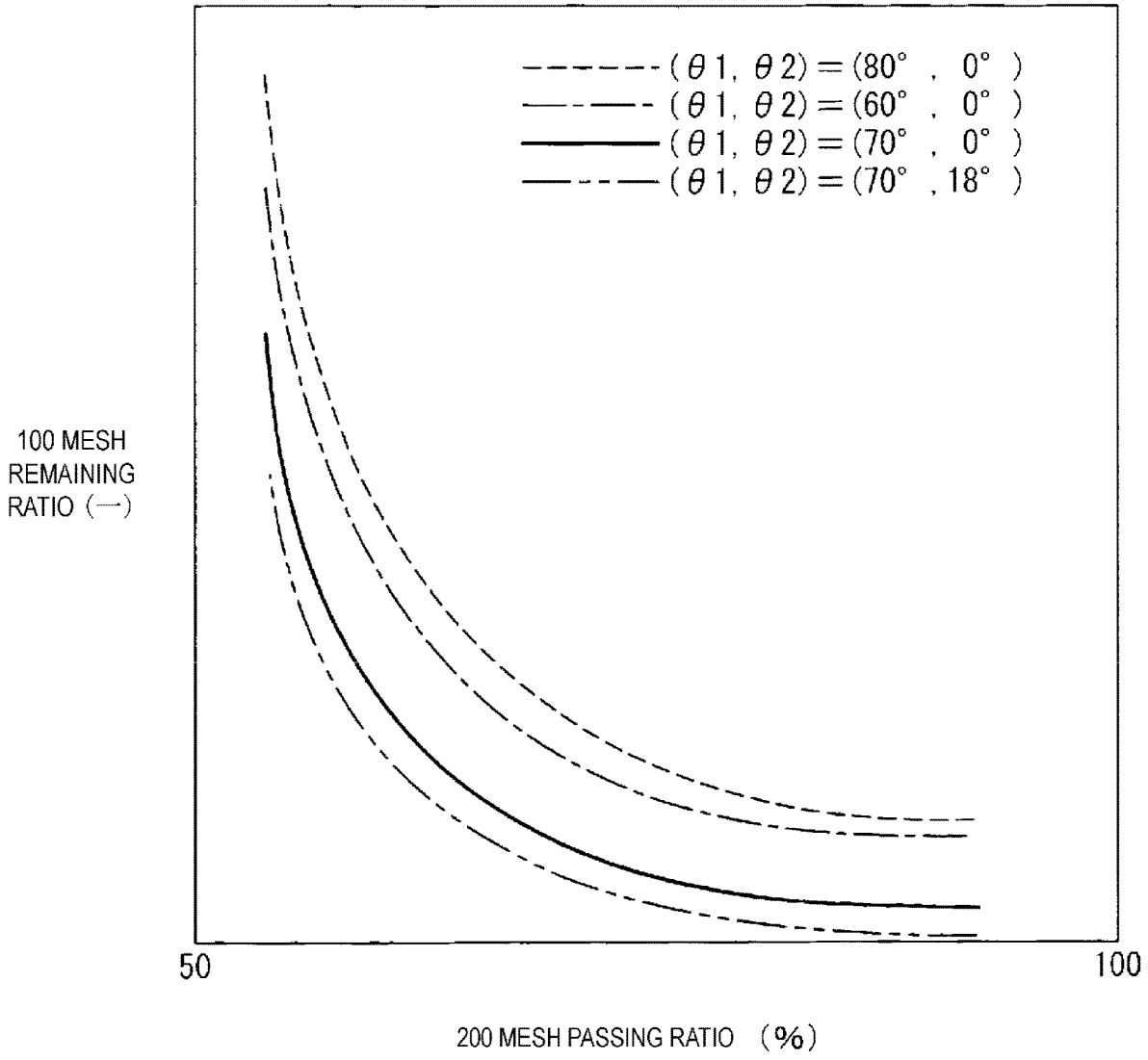
FIG. 5 is a chart showing the relationship between an integrated weight ratio of a solid fuel having a particle size that passes through a 200 mesh screen, and an integrated weight ratio of a remaining solid fuel having a particle size that does not pass through a 100 mesh screen.

The inventors compared the classification performances of the rotary classifier 40 using the classification blades 41 having various shapes obtained by changing the aforementioned angles θ1 and θ2, and obtained the results shown in FIG. 5.

FIG. 5 is a chart showing the relationship between the integrated weight ratio of a solid fuel having a particle size that passes through a 200 mesh screen, and the integrated weight ratio of a remaining solid fuel having a particle size that does not pass through a 100 mesh screen.

The "200 mesh passing ratio" shown in FIG. 5 indicates the integrated weight ratio of the solid fuel (fine powder having a particle size of 75 μm or less), among the solid fuel discharged from the rotary classifier 40 to the supply flow channel 42, that passes through a 200 mesh screen.

The "100 mesh remaining ratio" shown in FIG. 5 indicates the integrated weight ratio of the solid fuel (coarse powder having a particle size of 150 μm or greater), among the solid fuel discharged from the rotary classifier 40 to the supply flow channel 42, that does not pass through a 100 mesh screen. The "100 mesh remaining ratio" shown in FIG. 5 indicates the ratio of the remaining percentage when the regular 100 mesh remaining ratio is set as 1.

In FIG. 5, the "smaller 100 mesh remaining ratio" indicates a higher classification performance when the 200 mesh passing ratio is the same. Further, the "smaller 200 mesh passing ratio" indicates a higher classification performance when the 100 mesh remaining ratio is the same.

The results shown in FIG. 5 indicate that, when the longitudinal direction of the classification blade 41 is not inclined from the axis X direction (θ2=0°), setting θ1 to 70° results in a higher classification performance than when θ1 is set to 60° or 80°.

Further, the results shown in FIG. 5 indicate that, when the classification blade 41 has a shape such that θ1 is 70°, setting θ2 close to 18° results in a higher classification performance than when θ2 is set to 0°.

From the results shown in FIG. 5, the inventors discovered that a high classification performance is obtained by setting θ1 within a range of the Formula (1) below. In particular, the inventors discovered that a high classification performance is obtained by setting θ1 to 70°.

$$65° \leq \theta 1 \leq 75° \quad (1)$$

Further, from the results shown in FIG. 5, the inventors discovered that an even higher classification performance is obtained by setting θ2 within a range of the Formula (2) below. In particular, the inventors discovered that a high classification performance is obtained by setting θ2 to 18°.

$$13° \leq \theta 2 \leq 23° \quad (2)$$

With satisfaction of the Formula (1) above, the shape of the classification blade 41 is a shape that does not cause interference between the scattering directions Fo1, Fo2 in which the coarse powder scatters and the intake directions Fi1, Fi2 in which the fine powder is guided to the inner-circumferential-side space S2, and forms the scattering directions Fo1, Fo2 in a direction oriented upward relative to the horizontal direction.

In this case, θ2 may be set within a range of the Formula (3) below.

$$0° \leq \theta 2 \leq 23° \quad (3)$$

Further, with satisfaction of both Formula (1) and Formula (2), it is possible to establish a shape of the classification blade 41 that satisfies a higher classification performance.

The actions and effects exhibited by the vertical roller mill 100 of the above-described present embodiment will now be described.

According the vertical roller mill 100 of the present embodiment, the solid fuel supplied to the rotary table 10 by the fuel supply unit 20 is guided to the outer-circumferential-side space S1 of the rotary classifier 40 along with the primary air blown by the nozzles 50 upon pulverization by the rollers 30. Of the pulverized solid fuel, the fine powder smaller than the predetermined particle size is guided from the outer-circumferential-side space S1 to the inner-circumferential-side space S2 surrounded by the plurality of classification blades 41. Meanwhile, the intrusion of the coarse powder larger than the predetermined particle size into the inner-circumferential-side space S2 caused by collision with the plurality of classification blades 41 is suppressed.

According to the vertical roller mill 100 of the present embodiment, there is no interference between the scattering directions Fo1, Fo2 in which the coarse powder that collided with the classification blade 41 of the rotary classifier 40 scatters, and the intake directions Fi1, Fi2 in which the fine powder is guided to the inner-circumferential-side space S2. As a result, disruption of the intake of fine powder into the inner-circumferential-side space S2 by the coarse powder is suppressed, making it possible to enhance the intake efficiency of the fine powder from the outer-circumferential-side space S1 to the inner-circumferential-side space S2.

Further, when the classification blade 41 collides with the coarse powder, the coarse powder scatters in a direction oriented upward relative to the horizontal direction. As a result, an air stream flow oriented upward from below is formed in a region near the classification blade 41 of the outer-circumferential-side space S1, making it possible to suppress a defect in which the coarse powder flows from the outer-circumferential-side space S1 into the inner-circumferential-side space S2 due to disturbance of the air stream flow.

In the vertical roller mill 100 of the present embodiment, the surface through which an outer circumferential side end portion 41*c* of each of the plurality of classification blades 41 centered around the axis passes is a side surface of a circular truncated cone that protrudes downward from above along the axis X, and the angle formed by the side surface of the circular truncated cone and the plane orthogonal to the axis X is from 65 degrees to 75 degrees, both inclusive. In a particularly preferred configuration, this angle is set to 70 degrees.

The inventors changed the angle θ1 formed by the side surface of the circular truncated cone serving as the surface through which the outer circumferential side end portion 41*c* of each of the plurality of classification blades 41 passes, and the plane orthogonal to the axis X, compared the classification performances of the rotary classifier 40, and discovered that a high classification performance can be achieved by setting this angle to a value from 65 degrees to 75 degrees, both inclusive. In particular, the inventors discovered that a high classification performance can be achieved by setting this angle to 70 degrees.

According to the present embodiment, the inclination angle θ1 of the side surface of the circular truncated cone serving as the surface through which the outer circumferential side end portion 41*c* of each of the plurality of classification blades 41 passes is set to a value from 65 degrees to 75 degrees, both inclusive (preferably 70 degrees), with respect to the plane orthogonal to the axis X, making it possible to enhance the intake efficiency of the fine powder from the outer-circumferential-side space S1 to the inner-circumferential-side space S2 of the rotary classifier 40 and suppress the flow of the coarse powder from the outer-circumferential-side space S1 into the inner-circumferential-side space S2.

In the vertical roller mill 100 according to the present embodiment, each of the plurality of classification blades 41 has a plate shape with the first end portion 41*a* in the longitudinal direction along the axis Z disposed on the upper side along the axis X and a second end portion 41*b* disposed on the lower side along the axis X, and the longitudinal direction is inclined from the axial direction by θ2 so that the first end portion 41*a* is in a position receded further on an upstream side of the rotary classifier 40 in the rotational direction than the second end portion 41*b*.

According to the present embodiment, the longitudinal direction is inclined from the axis X direction by θ2 so that the first end portion 41*a* in the longitudinal direction of each of the plate shaped classification blades 41 is in a position receded further on the upstream side of the rotary classifier 40 in the rotational direction than the second end portion 41*b*. As a result, the normal direction of the plate shaped classification blade 41 is a direction inclined upward relative to the horizontal direction by the angle θ2. Thus, the coarse powder that collided with the classification blade 41 scatters in a direction oriented upward relative to the horizontal direction.

As a result, due to the action of the plate shaped classification blade 41 having the longitudinal direction inclined from the axis X direction by the angle θ2, an air stream flow oriented upward from below is reliably formed in a region near the classification blade 41 of the outer-circumferential-side space S1, making it possible to suppress a defect in which the coarse powder flows from the outer-circumferential-side space S1 into the inner-circumferential-side space S2 due to disturbance of the air stream flow.

In the vertical roller mill 100 of the present embodiment, the longitudinal direction is inclined at an angle of from 13 degrees to 23 degrees, both inclusive, from the axis X direction when the classification blade 41 is orthogonal to the axis X and viewed from a radial direction that passes through the classification blade 41 and the axis X.

The inventors changed the inclination angle of the plate shaped classification blade 41 having a longitudinal direction inclined from the axis X direction (the angle at which the longitudinal direction of the classification blade 41 is in the axis X direction when the classification blade 41 is viewed from the radial direction), compared the classification performances of the rotary classifier 40, and discovered that a high classification performance can be achieved by setting this angle to a value from 13 degrees to 23 degrees, both inclusive. In particular, the inventors discovered that a high classification performance can be achieved by setting this angle to 18 degrees.

According to the present embodiment, it is possible to enhance the intake efficiency of the fine powder from the outer-circumferential-side space S1 to an inner-circumferential-side space S2 of the rotary classifier 40 and, at the same time, suppress the flow of the coarse powder from the outer-circumferential-side space S1 into the inner-circumferential-side space S2.

REFERENCE SIGNS LIST

10 Rotary table
10*a* Central portion
10*b* Outer circumferential portion
20 Fuel supply unit
30 Roller
31 Rocking shaft
32 Roller main body
33 Support shaft
40 Rotary classifier
41 Classification blade (blade)
41*a* First end portion
41*b* Second end portion
41*c* Outer circumferential side end portion
42 Supply flow channel
50 Nozzle (ventilation unit)
51 Primary air flow channel
60 Housing
70 Drive unit
71 Drive shaft
80 Swirling vane
100 Vertical roller mill
S1 Outer-circumferential-side space
S2 Inner-circumferential-side space
X, Y Axis

The invention claimed is:

1. A vertical roller mill, comprising:

a rotary table that rotates about an axis by a driving force from a drive unit;

a fuel supply unit for supplying a solid fuel to the rotary table;

a roller for pulverizing the solid fuel supplied to the rotary table;

a rotary classifier for causing a plurality of blades provided above the rotary table and disposed around the axis to rotate about the axis; and a ventilation unit for blowing oxidizing gas for supplying the solid fuel pulverized by the roller to the rotary classifier;

the rotary classifier guiding, of the solid fuel pulverized by the roller, fine powder smaller than a predetermined particle size from an outer-circumferential-side space to an inner-circumferential-side space surrounded by the plurality of blades, and suppressing, by collision with the plurality of blades, an intrusion of coarse powder larger than the predetermined particle size into the inner-circumferential-side space; and each of the plurality of blades having a plate shape with a first end portion in a longitudinal direction disposed on an upper side along the axis and a second end portion disposed on a lower side along the axis, and the longitudinal direction being inclined from the axial direction so that the first end portion is positioned behind the second end portion in the rotational direction of the rotary classifier.

2. The vertical roll mill according to claim 1, wherein:

a surface through which an outer circumferential side end portion of each of the plurality of classification blades centered around the axis passes is a side surface of a circular truncated cone that protrudes downward from above along the axis; and an angle formed by the side surface of the circular truncated cone and a plane orthogonal to the axis is from 65 degrees to 75 degrees, both inclusive.

3. The vertical roller mill according to claim 2, wherein the angle formed by the side surface of the circular truncated cone and the plane orthogonal to the axis is 70 degrees.

4. The vertical roller mill according to claim 1, wherein the longitudinal direction is inclined at an angle of from 13 degrees to 23 degrees, both inclusive, from the axial direction when the blade is orthogonal to the axis and viewed from a radial direction that passes through the blade and the axis.

5. The vertical roller mill according to claim 4, wherein the longitudinal direction is inclined at an angle of 18 degrees from the axial direction when the blade is orthogonal to the axis and viewed from a radial direction that passes through the blade and the axis.

* * * * *